United States Patent [19]

Futakuchi

[11] Patent Number: 4,632,073

[45] Date of Patent: Dec. 30, 1986

[54] CAMSHAFT MOUNTING MECHANISM FOR DOHC ENGINE OF MOTORCYLE

[75] Inventor: Yorio Futakuchi, Shizuoka, Japan

[73] Assignee: Yamaha Hatsudoki Kabushiki Kaisha, Iwata, Japan

[21] Appl. No.: 610,848

[22] Filed: May 16, 1984

[51] Int. Cl.[4] ..... F01L 1/02

[52] U.S. Cl. ..... 123/90.27; 123/432

[58] Field of Search ..... 123/90.16, 90.17, 90.27, 123/90.31, 308, 315, 432

[56] References Cited

U.S. PATENT DOCUMENTS

| | | | |
|---|---|---|---|
| 1,398,651 | 11/1921 | Rowledge | 123/90.27 |
| 2,054,928 | 9/1936 | Church | 123/90.27 |
| 3,289,658 | 12/1966 | Surovek | 123/90.27 |
| 3,388,614 | 6/1968 | Castelet | 123/90.27 |
| 3,673,990 | 7/1972 | Alfieri | 123/90.27 |
| 4,256,068 | 3/1981 | Irimajiri et al. | 123/432 |
| 4,430,968 | 2/1984 | Futakuchi et al. | 123/90.27 |
| 4,495,903 | 1/1985 | Asano | 123/90.38 |

FOREIGN PATENT DOCUMENTS

| | | | |
|---|---|---|---|
| 32946 | 3/1980 | Japan | 123/90.16 |
| 0002409 | 1/1982 | Japan . | |
| 91310 | 5/1983 | Japan | 123/90.31 |

*Primary Examiner*—Craig R. Feinberg
*Assistant Examiner*—David A. Okonsky
*Attorney, Agent, or Firm*—Ernest A. Beutler

[57] ABSTRACT

Two embodiments of overhead camshaft internal combustion engines that provide a compact arrangement through a simplified bearing and thrust arrangement for the camshafts. In accordance with each embodiment, one of the lobes of the camshafts are positioned at the ends of the camshafts and the camshafts are axially located by thrust surfaces formed between pairs of lobes. In one embodiment of the invention, the camshaft operates three valves per cylinder. In this embodiment, the fastening means for affixing the cylinder head to the cylinder block lies beneath the camshafts and the camshafts have openings so that the fastening means may be tightened without necessitating removal of the camshafts.

16 Claims, 6 Drawing Figures

CAMSHAFT MOUNTING MECHANISM FOR DOHC ENGINE OF MOTORCYLE

BACKGROUND OF THE INVENTION

This invention relates to a camshaft mounting arrangement for a motorcycle and more particularly to an improved camshaft and valve train arrangement for an internal combustion engine.

The advantages of overhead camshaft internal combustion engines are well known. Such engines normally can develop greater horsepowers than engines having other types of valve actuation since the overhead camshaft and more direct valve actuation reduces the weight and number of components in the valve train. The use of overhead camshafts has even further advantages when the individual cylinders of the engine are provided with multiple intake and/or exhaust valves. However, the overhead positioning of a camshaft gives rise to some difficulties in design, assembly and servicing. For example, the camshaft must be journaled for rotation, must be fixed in an axial location and, of course, must be driven. All of these ancillary components tend to complicate the cylinder head structure and in some instances can give rise to an enlargement of the engine. This can present specific problems when the engine is used with a compact vehicle such as a motorcycle.

For example, the use of multiple cylinder internal combustion engines for motorcycles is well known. One popular type of engine arrangement embodies two or more cylinders arranged in an inline relationship. It is possible to make the motorcycle more compact and achieve a better weight balance if the inline cylinders are disposed so that the crankshaft axis is transverse to the longitudinal center of the motorcycle rather than being longitudinally aligned with. However, the previously proposed arrangements for driving and supporting overhead camshafts have tended to increase the length of the engine. When the engine is mounted transversely in a motorcycle, therefore, the increase in length tends to encroach upon the area between the rider's knees. To compensate for this, it has been proposed to move the rider's seat rearwardly on the motorocycle. This has a number of disadvantages in that it may cause an awkward riding position and also may adversely affect the balance of the motorcycle.

It is, therefore, as principal object of this invention to provide an improved camshaft arrangement for an overhead cam engine.

It is another object of the invention to provide an improved and simplified camshaft arrangement for an overhead cam engine which does not increase the length of the engine.

As has been previously noted, with an overhead mounted camshaft, it is necessary to journal the camshaft for rotation and also to provide some form of thrust bearing for axially locating the camshaft. With overhead camshafts of the type previously proposed, the thrust bearing arrangements have been positioned at one or both ends of the camshaft spaced longitudinally beyond the outermost cam lobes. Such an arrangement obviously increases the length of the engine.

It is, therefore, a still further object of this invention to provide an improved bearing arrangement for rotatably journaling and axially locating a camshaft.

It is a further object of this invention to provide a more compact bearing arrangement for the camshaft of an overhead cam internal combustion engine.

In conjunction with overhead camshaft engines having multiple valves per cylinder, it has been the practice to employ a separate cam lobe for actuating each valve. When a multiple number of valves is used, however, this has a tendency to increase the length of the camshaft and it is desirable to insure that the camshaft is journaled in such a manner so as to avoid distortion. That is, when a camshaft is provided with a plurality of cam lobes, it is desirable to insure that adequate bearing arrangements are provided along the entire length of the camshaft. However, devices proposed for such arrangements have lengthened the engine and have increased the complexity of the cylinder head assembly.

It is, therefore, a further object of this invention to provide an improved, simplified and compact bearing arrangement for a multiple value overhead cam internal combustion engine.

As has been previously noted, the provision of overhead camshafts tends to complicate the overall cylinder head construction. Furthermore, it is desirable to provide an arrangement wherein the cylinder head may be tightened such as retorqued without necessitating removal of the camshaft or camshaft supporting components.

It is, therefore, a still further object of this invention to provide an improved bolting and bearing arrangement for an overhead cam internal combustion engine that permits retorquing of the cylinder head hold-down members without removal of the camshafts or camshaft supports.

SUMMARY OF THE INVENTION

A first feature of this invention is adapted to be embodied in a camshaft arrangement for an overhead camshaft type internal combustion engine comprising a cylinder head assembly supporting a plurality of poppet valves for reciprocation and a camshaft journaled by the cylinder head assembly and having a plurality of spaced cam lobes thereon for actuating the valves. In accordance with a first feature of the invention, thrust means are formed on the camshaft between its end and between at least two adjacent cam lobes. Thrust bearing means are formed by the cylinder head assembly for engaging the camshaft thrust means for axially locating the camshaft.

Another feature of the invention is also adapted to be embodied in a camshaft arrangement for an overhead camshaft type internal combustion engine that includes a cylinder head assembly supporting a plurality of poppet valves and a camshaft that is journaled by the cylinder head assembly and which has a plurality of spaced cam lobes for actuating the valves. In accordance with this feature of the invention, at least one of the cam lobes is formed at one end of the camshaft and the camshaft does not extend at this end past the cam lobe.

Still a further feature of the invention is also adapted to be embodied in an overhead camshaft type internal combustion engine embodying a cylinder head and a journaled camshaft as described in the preceding paragraphs. In accordance with this feature of the invention, the camshaft is formed with at least three adjacent lobes with a pair of spaced bearing surfaces each being interposed between the center one of these three lobes and one of the end lobes. The camshaft is journaled by the cylinder head assembly by means that include a single bearing cap fixed relative to the cylinder head assembly and having spaced bearing surfaces engaging respective of the camshaft bearing surfaces.

A still further feature of this invention is adapted to be embodied in a cylinder head assembly for an internal combustion engine that has a cylinder block, a cylinder head, fastening means for securing the cylinder head to the cylinder block, a camshaft adapted to be journaled by the cylinder head and having a plurality of cam lobes adapted to operate valves carried by the cylinder head. The camshaft is journaled by at least one bearing cap that is fixed relative to the cylinder head assembly. In accordance with this feature of the invention, the bearing cap and camshaft have portions that lie over at least one of the cylinder head fastening means. These portions of the bearing cap and camshaft are formed with apertures that are sized so as to pass a tool for tightening of the one cylinder head fastening means without removal of the bearing cap and/or camshaft.

DETAILED DESCRIPTION OF THE PREFERRED EMBODIMENTS

Embodiment of FIGS. 1 Through 4

Figure 1:
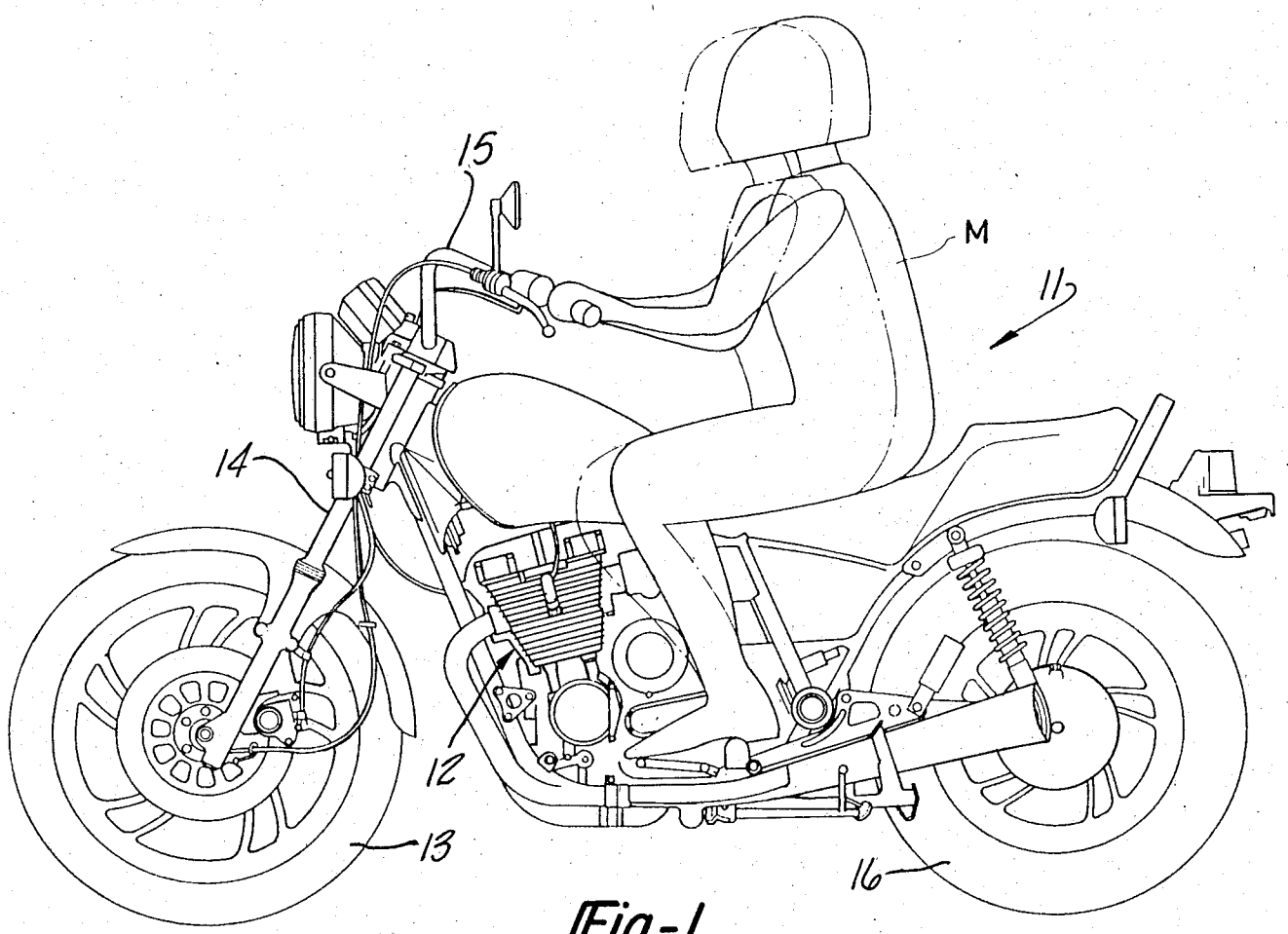
FIG. 1 is a side elevational view of a motorcycle incorporating an internal combustion engine constructed in accordance with an embodiment of the invention.

A motorcycle is identified generally by the reference numeral 11 and incorporates an internal combustion engine, indicated generally by the reference numeral 12, and constructed in accordance with a first embodiment of the invention. The motorcycle 11 has a front wheel 13 that is journaled for steering movement by means of a fork assembly 14 and which may be steered by means of a handlebar assembly 15 in a known manner. A rear wheel 16 is driven from the engine 12 in an appropriate manner.

Figure 2:
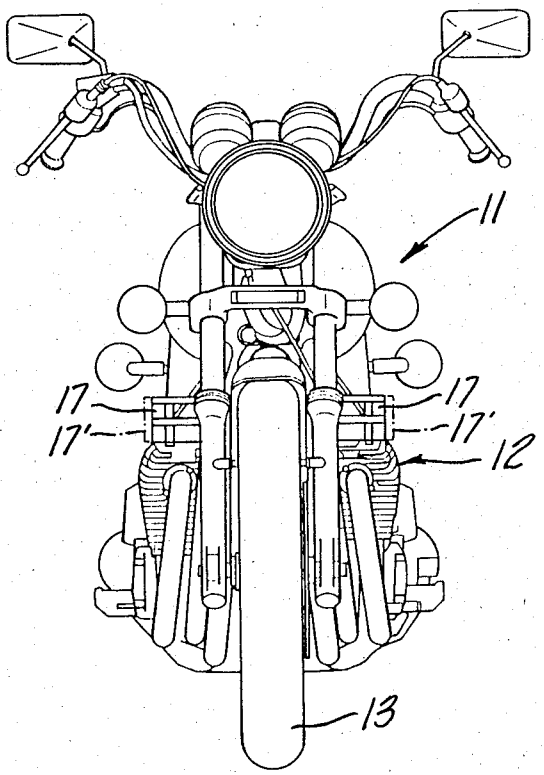
FIG. 2 is a front elevational view of the motorcycle shown in FIG. 1.

The engine 12 is of the inline two cylinder type and is disposed transversely of the longitudinal axis of the motorcycle 11 so that the crankshaft of the engine 12 rotates about an axis that is generally parallel to the axis of rotation of the wheels 13 and 16. Such an arrangement provides good weight distribution and affords a compact assembly. However, such a disposition of the engine 12 with camshaft drive arrangements of the type previously proposed has caused the camshaft covers 17' of conventional engines to be disposed at a fairly substantial transverse distance as shown by the phantom line views in FIG. 2. As a result, the operator M must be seated rearwardly so that his knees will clear the cam covers 17' as shownin the solid line view of FIG. 1. Such rearward positioning may give rise to an awkward riding position and also may necessitate a lengthening of the wheel base of the motorcycle 11, which may be undesirable. In accordance with this invention, as will become apparent, the camshaft drive and supporting arrangement is such that the cam covers 17 may be spaced inwardly as shown in FIG. 2 by the solid line view, sufficiently so that the rider M may be seated forwardly as shown in the phantom line view in FIG. 1. This provides better weight distribution and a better riding position.

Figure 3:
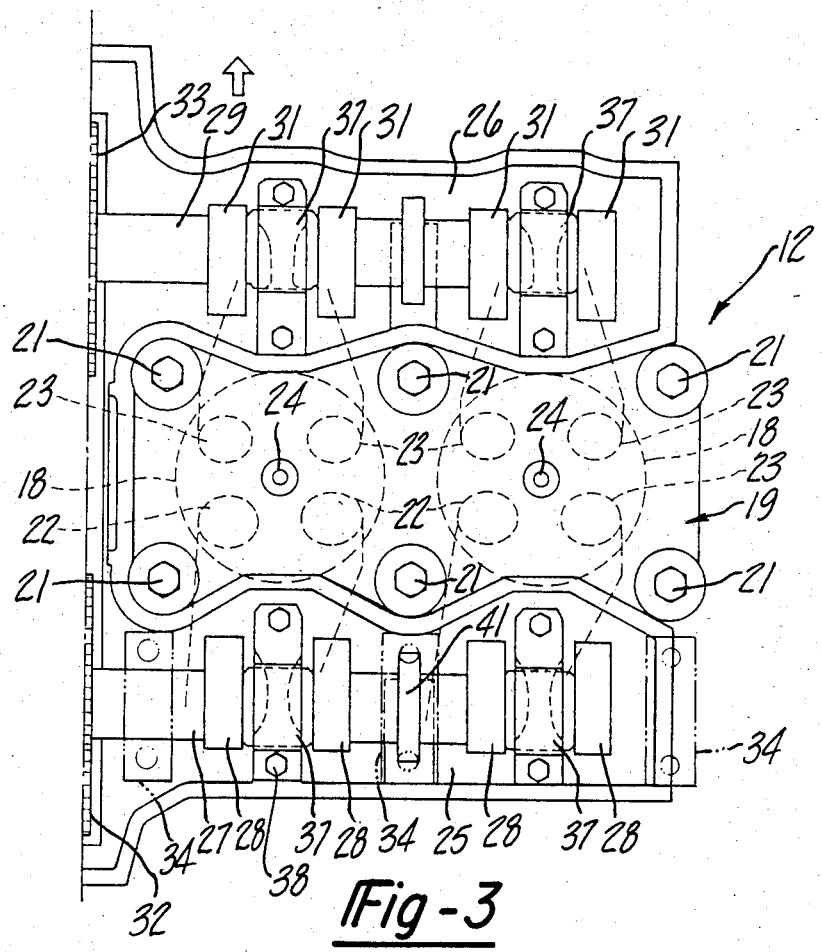
FIG. 3 is a top plan view of the cylinder head assembly of the engine of the motorcycle of this embodiment with the cam covers removed.
Figure 4:
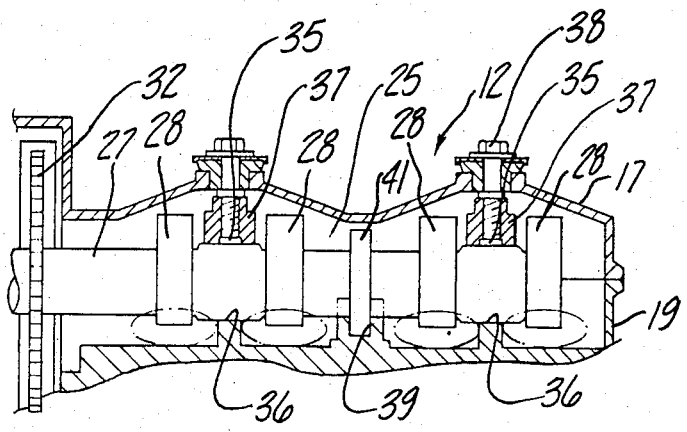
FIG. 4 is a vertical cross-sectional view taken through one of the camshafts of the engine of this embodiment.

The valve train arrangement that permits this compact assembly and specifically the support and drive for the camshafts may be best understood by reference to FIGS. 3 and 4 wherein FIG. 3 is a top plan view of the engine with the camshaft cover 17 removed and FIG. 4 is a vertical cross-sectional view taken through the axis of rotation of one of the camshafts. The engine 12 includes a cylinder block in which a pair of cylinder bores 18 are formed. As has been previously noted, this embodiment comprises a two cylinder inline engine. It should be readily apparent to those skilled in the art, however, that certain facets of the invention may be used in conjunction with other types of engines and specifically with those having more than two aligned cylinders. The pistons, connecting rods and so on associated with the engine 12 may be considered to be conventional and, for that reason, these components have not been illustrated nor will they be described in detail.

A cylinder head assembly, indicated generally by the reference numeral 19, is affixed to the cylinder block by means of a plurality of fasteners 21. The fasteners 21 are disposed at opposite sides of the cylinder block and are disposed outwardly of the ends of the cylinders 18 and between them as may be readily apparent from an inspection of FIG. 3.

The invention has particular utility in conjunction with engines having at least two intake or exhaust valves per cylinder and in the illustrated embodiment, the engine 12 is provided with two intake valves 22 per cylinder and two exhaust valves 23 per cylinder. The engine is disposed so that the intake ports associated with the intake valves 22 extend rearwardly through the cylinder head 19 while the exhaust ports associated with the exhaust valves 23 extend forwardly through the cylinder head 19. The configuration of the porting associated with the valves 22 and 23 and the associated intake and exhaust systems form no part of this invention and, for that reason, these components have not been illustrated in any detail nor will they be described.

Spark plugs 24 are positioned in the cylinder head 19 and associated with each of the cylinders 18 for firing the charge therein in a known manner.

The cylinder head assembly 19 defines an intake cam chamber 25 at its rear end and an exhaust cam chamber 26 at its forward end. The cam chambers 25 and 26 are enclosed by the cam covers 17 in a manner which will be described.

An intake cam 27 is positioned within the intake cam chamber 25 and is rotatably journaled, in a manner to be described. The intake cam 27 has a plurality of lobes 28, each of which is associated with a stem of a respective one of the intake valves 22 by means which may include adjusting tappets so that the valves 22 will be directly actuated, each by its respective cam lobe.

In a similar manner, an exhaust camshaft 29 is positioned within the exhaust cam chamber 26 and has respective lobes 31 that are engaged with the valve stems of the exhaust valves 23 through suitable tappet adjusters so as to directly actuate the exhaust valves 23. Driving sprockets 32 and 33 are affixed to the forward ends of the respective camshafts 27 and 29 and are driven at one-half crankshaft speed by means of a chain (not shown).

In a conventional camshaft mounting arrangement, each of the camshafts 27 and 29 will be elongated so as to run the full length of the cylinder head assembly 19. The ends and intermediate portion of each camshaft 27 and 29 will be provided with bearing surfaces in a conventional arrangement and will be supported for rotation by bearing surfaces formed in the cylinder head assembly and by means of spaced bearing caps, as shown in phantom line and identified by the reference numeral 34. One or more of these bearing caps and the associated cam bearing surface will be formed with engaging thrust surfaces for axially locating the respective camshafts 27 and 29 in the conventional arrangement. As has been previously noted, this type of conventional arrangement unduly elongates the engine.

In accordance with this invention, the intake cam 27 and exhaust cam 29 are provided with two spaced bearing surfaces 35, each of which is located between pairs of the cam lobes 28 or 31, associated with each of the cylinders 18. These cam bearing surfaces 35 are journaled by means of bearing surfaces 36 formed integrally with the cylinder head 19 and bearing surfaces formed by bearing caps 37 that are affixed to the cylinder head 19 by means of bolts 38. Thus, a more compact arrangement is provided. It should be noted that, as shown in FIG. 4, the cam covers 17 are affixed to the cylinder head assembly 19 by means of threaded fasteners 38 that pass into tapped openings formed in the bearing caps 37.

In accordance with the invention, the cylinder head 19 is also provided with a thrust bearing groove 39 that receives a thrust bearing surface 41 formed on each of the camshafts between the cylinders 18. Thus, the thrust bearing arrangement is taken care of independently of the bearings which rotatably journal the respective camshafts 27 and 29. This further permits a more compact assembly. It should also be noted that the right side lobes 28 and 31 associated with each of the camshafts 27 and 29, as viewed in FIG. 3, are formed at the extreme ends of these camshafts and that the camshafts do not extend beyond these lobes. This still further permits a more compact assembly.

This compact arrangement is provided without at all sacrificing the rigidity or full support for the respective camshafts. In fact, the disclosed arrangement provides the bearing surfaces closely adjacent the cam lobes and thus the likelihood of bending is further reduced.

Figure 5:
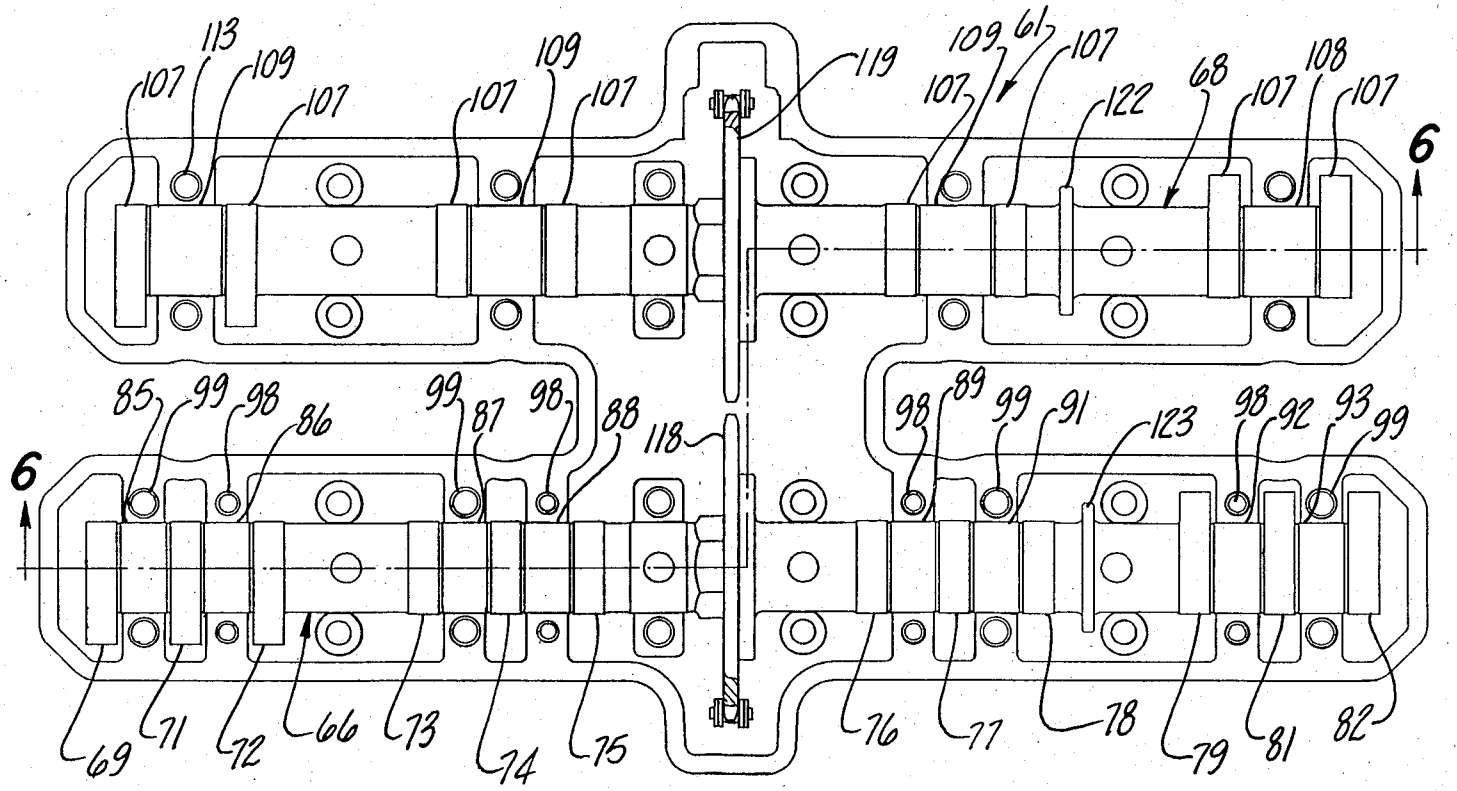
FIG. 5 is a top plan view, in particular similar to FIG. 3, and shows another embodiment of the invention with the cam covers removed.
Figure 6:
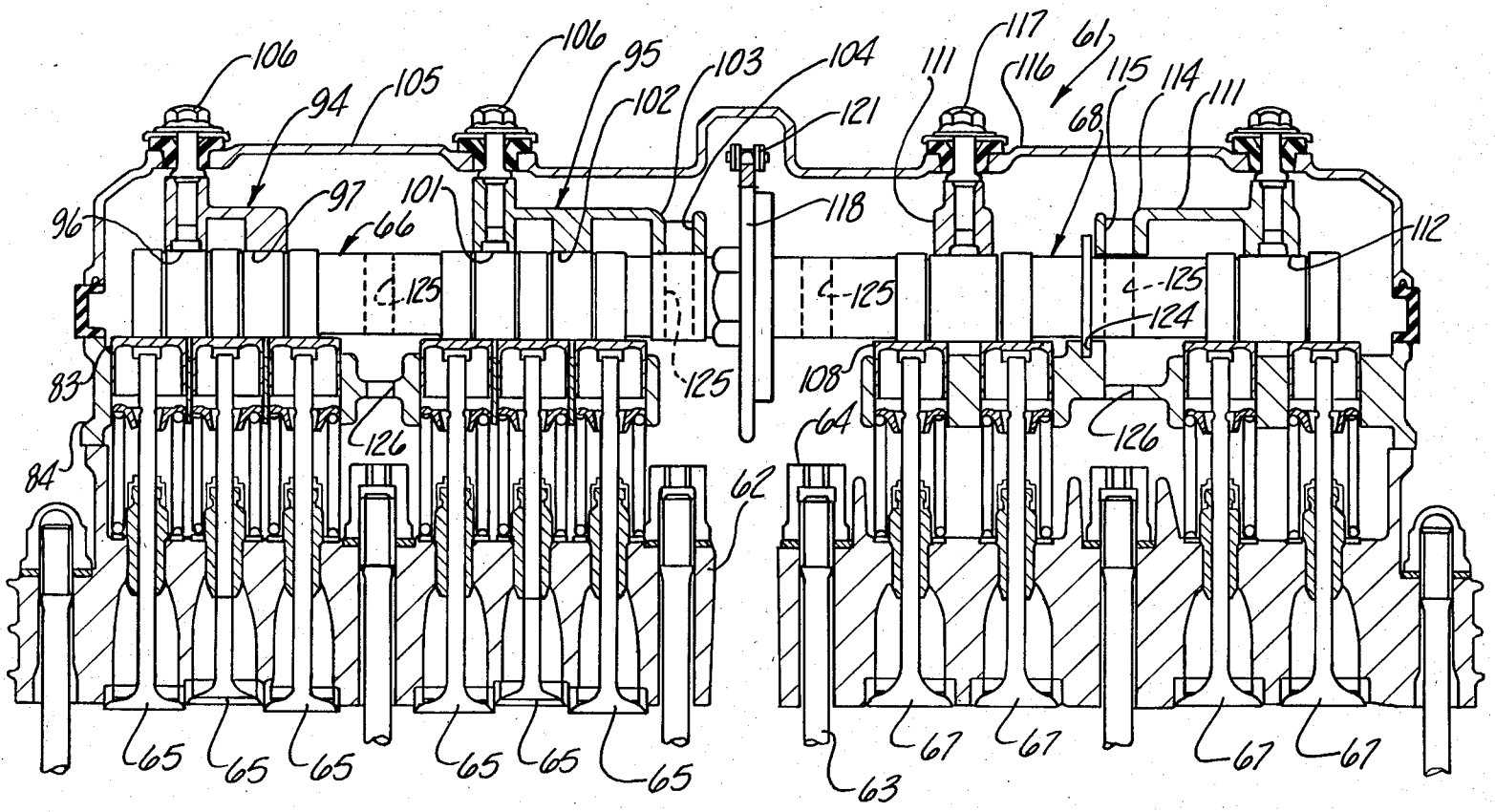
FIG. 6 is a cross-sectional view taken along the line 6—6 of FIG. 5.

Embodiment of FIGS. 5 and 6

A cylinder head assembly constructed in accordance with a further embodiment of the invention is identified generally by the reference numeral 61. As with the embodiment of FIGS. 1 through 4, the invention resides in the construction and support for the camshafts and their association with the cyinder head assembly 61. For that reason, the cylinder block has not been illustrated and it may be considered to be conventional. The embodiment shown in these figures is intended for use with a four cylinder inline engine. As with the previously described embodiment, however, the invention or facets of it may be used in conjunction with engines having other numbers of cylinders than four.

The cylinder head assembly 61 includes a cylinder head 62 that is affixed to the associated cylinder block by means of studs 63 that are fixed to the cylinder block and socket headed fasteners 64. The reason for the socket headed fasteners 64 will become apparent as this description proceeds.

In accordance with this embodiment, each cylinder of the engine is provided with three intake valves 65 which are slidably supported within the cylinder head 62 for reciprocation in any suitable manner. In accordance with this embodiment, all of the intake valves 65 are disposed at one side of the engine and in this embodiment the intake side is the lowermost side as viewed in FIG. 5. The intake valves 65 are operated by means of an intake camshaft, which is indicated generally by the reference numeral 66.

The engine in accordance with this embodiment is provided with two exhaust valves 67 for each cylinder. The exhaust valves 67 are disposed on the opposite side of the engine and are all operated by an exhaust camshaft, indicated generally by the reference numeral 68.

The intake camshaft 66 has its lobes arranged in sets of three for operating the intake valves 65 associated with each cylinder. These sets of lobes comprise lobes 69, 71 and 72; 73, 74 and 75; 76, 77 and 78; and 79, 81 and 82. Each of the lobes 69, 71 through 79, 81 and 82 operates a respective intake valve 65 by means of an inverted thimble tappet 83, each of which is supported for sliding movement in a tappet body 84. The tappet body 84 is affixed to the cylinder head 62 in a manner to be described. Suitable adjusting means may be provided in the tappet bodies 83 and, of course, return spring assemblies are associated with each of the intake valves 65 for closing them in a known manner.

Pairs of bearing surfaces are interposed along the camshaft 66 between the centermost cam lobe 71, 74, 76 and 81 of each set and the end cam lobes 69, 72, 73, 75, 76, 78 and 79, 82 of each set. These bearing surfaces are indicated by the reference numerals 85, 86, 87, 88, 89, 91, 92, and 93. The intake camshaft 69 is rotatably journaled by means of bearing caps of two types, a first type 94 which is associated with the camshaft bearing surfaces 85 and 86 and with the camshaft bearing surfaces 89 and 91 and a second type, indicated generally by the reference numeral 95, which is associated with the camshaft bearing surfaces 87 and 88 and 92 and 93. The differences for the construction between the bearing caps 94 and 95 will become apparent.

The bearing caps 94 have first bearing surfaces 96 and second bearing surfaces 97. As may be readiy apparent from FIG. 6, the bearing surface 96 cooperates with the camshaft bearing surface 85 and the bearing surface 97 cooperates with the camshaft bearing surface 86. When associated with the bearing surfaces 89 and 91, the bearing surface 96 cooperates with the camshaft bearing surface 91 and the bearing surface 97 cooperates with the camshaft bearing surface 89. The bearing caps 94 are affixed relative to the cylinder head assembly 62 by means of studs that are affixed to the cylinder head 62 and which pass through apertures in the tappet body 84 so as to affix both bearing caps 94 and tappet body 84 to the cylinder head 62. These studs comprise smaller diameter studs 98 that are associated with the cantilevered bearing surfaces 97 and larger diameter bearing studs 99 that are associated with the bearing surfaces 96 of the bearing caps 94.

The bearing caps 95 are comprised of a bearing surface 101 that is adapted to cooperate with the camshaft bearing surfaces 87 or 93 and a bearing surface 102 that is adapted to cooperate with the camshaft bearing surface 88 and 92. As with the bearing halves 94, the cantilevered bearing surfaces 102 are affixed to the cylinder head assembly by means of the smaller diameter studs 98 and associated nuts. The bearing surfaces 101 are affixed to the cylinder head assembly by means of the larger diameter studs 99 and associated nuts. The bearing halves 95 further have an extending portion 103 that is formed with an enlarged aperture 104, for a reason to be described.

An intake cam cover 105 encloses the intake camshaft 66 and is affixed to the cylinder head assembly by means of threaded fasteners 106 that are threaded into tapped openings formed in the respective bearing caps 94 and 95.

Referring now to the exhaust camshaft 68, it is provided with pairs of cam lobes 107 associated with each of the cylinders. The cam lobes 107 cooperate with inverted thimble tappet followers 108 that are slidably supported within the tappet body 84 for operating the exhaust valves 67 in a known manner. The pairs of cam lobes 107 have bearing surfaces 109 disposed between them. The exhaust camshaft 68 is rotatably journaled by means of bearing caps 111. Each bearing cap 111 has a bearing surface 112 that is associated with the respective camshaft bearing surface 109. The bearing caps 111 are affixed to the cylinder head by means of studs 113 that are disposed on opposite sides of the bearing surfaces 109 and which are threaded into the cylinder head 62. These studs pass through apertures in the tappet body 84 and nuts affix the bearing caps 111 and tappet body 84 to the cylinder head 62 in a manner similar to that associated with the intake camshaft 66. As with the intake bearing caps 95, the bearing caps 111 have cantilevered portions 114 in which apertures 115 are formed. These cantilevered portions may also be affixed to the cylinder head 62 by means of studs and nuts.

An exhaust cam cover 116 is affixed to the exhaust side of the engine to enclose the exhaust cam 68 by means of threaded fasteners 117 that are received in tapped openings in the bearing halves 111.

The camshafts 66 and 68 are driven by means of respective sprockets 118 and 119 that are affixed against rotation to the respective camshafts betwen the centermost pair of cylinders. A chain 121 is driven in an appropriate manner from the associated crankshaft (not shown) so as to drive the camshafts 66 and 68 at one-half crankshaft speed, as is well known.

The exhaust camshaft 68 and intake camshaft 69 are each provided with respective thrust bearing surfaces 122 and 123 for axially locating the respective camshafts. The thrust bearing surfaces 122 and 123 are received in respective thrust grooves 124 (only one of which shows in the drawings in FIG. 6) formed in the tappet body 84 so as to provide the axial location in a manner similar to that of the embodiment of FIGS. 1 through 4.

As has been noted, the cylinder head 62 is affixed to the cylinder block by means of studs 63 and socket headed fasteners 64. The studs 63 and socket headed fasteners 64 are disposed so that they are aligned with and positioned beneath the respective camshafts 66 and 67. In order to afford an arrangement for torqueing the fasteners 64 without necessitating removal of the camshafts 66 and 68, each camshaft is provided with a through bore 125 that is aligned with each of the studs 63 and which is sized so as to pass an appropriate tool for cooperation with the socket heads of the fasteners 64 so as to tighten them. In a like manner, the tappet body 84 is provided with corresponding apertures 126 where necessary. The apertures 104 of the bearing caps 95 and the apertures 115 of the bearing caps 111 are also sized to pass these tools and overlie the similar openings 125 in the respective camshafts 66 and 68 so as to permit this tightening without removal of the camshafts 66 and 68.

It should be noted that in this embodiment, the outermost lobes 69 and 82 of the intake camshaft 66 and the outermost lobes 107 of the exhaust camshaft 68 are disposed at the extreme ends of the camshafts. That is, these lobes 69, 82 and 107 are in, effect, cantilevered and the camshafts do not extend beyond these lobes. As with the embodiment of FIGS. 1 through 4, this provides an extremely compact assembly.

From the foregoing description of the preferred embodiments, it should be readily apparent that a highly effective and yet extremely compact arrangement has been provided for supporting and driving the overhead camshafts of a multiple valve engine. Furthermore, the construction is such that the cylinder head hold-down mechanisms may be retorqued without necessitating removal of the camshafts. Although two embodiments of the invention have been illustrated and described, various changes and modifications may be made without departing from the spirit and scope of the invention, as defined by the appended claims.

I claim:

1. In a camshaft arrangement for an overhead camshaft type internal combustion engine comprising a cylinder head assembly defining at least two combustion chambers and supporting a plurality of poppet valves for reciprocation, at least two of said poppet valves serving each of said combustion chambers, a camshaft journaled by said cylinder head assembly and having a plurality of spaced cam lobes thereon for actuating said valves with interposed bearing surfaces between the cam lobes associated with the valves serving each combustion chamber, said camshaft being rotatably supported by only said bearing surfaces, bearing cap means affixed to said cylinder head assembly and having bearing surfaces engaging said camshaft bearing surfaces for journaling said camshaft on said cylinder head assembly, at least one of said cam lobes being formed at one end of said camshaft and the camshaft does not extend beyond that one cam lobe, a thrust bearing comprising oppositely facing surfaces formed on said camshaft and spaced axially from the other of said bearing surfaces, and a thrust bearing groove formed in said cylinder head assembly other than said bearing cap means and spaced axially therefrom and cooperating with said camshaft thrust bearing surfaces for axially positioning said camshaft on said cylinder head assembly.

2. In a camshaft arrangement as set forth in claim 1 wherein each end of the camshaft terminates at a cam lobe and further including drive means for driving the camshaft between its ends.

3. In a camshaft arrangement as set forth in claim 2 wherein the thrust bearing surfaces are positioned between the ends of the camshaft and between pairs of adjacent lobes of the camshaft.

4. In a camshaft arrangement as set forth in claim 2 further including means for affixing the cylinder head assembly to an associated cylinder block including fastening means, the fastening means being positioned beneath the camshaft, the camshaft having openings formed therein for passing a tool for tightening the fastening means without removal of the camshaft.

5. In a camshaft arrangement as set forth in claim 1 wherein the thrust bearing surfaces are positioned between the ends of the camshaft and between pairs of adjacent lobes of the camshaft.

6. In a camshaft arrangement as set forth in claim 5 wherein there are three valves associated with each cylinder of the engine and the camshaft is provided with a separate lobe for operating each valve.

7. In a camshaft arrangement as set forth in claim 6 wherein the cylinder head assembly comprises a cylinder head casting, a tappet body affixed to said cylinder head casting, and means for affixing said bearing cap means to said tappet body and to said cylinder head casting, said tappet body slidably supporting a plurality of tappets interposed between the respective cam lobes and the respective valves for operating the valves.

8. In a camshaft arrangement as set forth in claim 7 wherein the thrust bearing groove of the cylinder head assembly comprises thrust bearing surfaces formed by a groove in the tappet body.

9. In a camshaft arrangement for an overhead camshaft type internal combustion engine comprising a cylinder head assembly supporting a plurality of poppet valves for reciprocation, a combustion chamber formed in part by said cylinder head assembly, at least three of said valves serving said combustion chamber, and a camshaft journaled by said cylinder head assembly and having a plurality of spaced cam lobes therein for actuating said valves, the improvement comprising said camshaft being formed with at least three adjacent lobes each associated with a respective one of said three valves and a pair of spaced bearing surfaces each being interposed between the center one of said three lobes and the end one of said three lobes and a third bearing surface spaced axially away from said lobes, the means for journaling said camshaft comprising a single bearing cap fixed relative to said cylinder head assembly and having spaced bearing surfaces engaging respective of said pair of said camshaft bearing surfaces and said third bearing surface.

10. In a camshaft arrangement as set forth in claim 9 further including bolting means for bolting said bearing cap to said cylinder head assembly comprising a pair of stud receiving openings disposed on opposite sides of each of said bearing cap bearing surfaces.

11. In a camshaft arrangement as set forth in claim 10 wherein the cylinder head assembly comprises a cylinder head adapted to reciprocally support the poppet valves, a tappet body interposed between said cylinder head and said bearing cap and having bores for slidably supporting tappets interposed between the bearing lobes and the poppet valves.

12. In a camshaft arrangement as set forth in claim 11 further including a thrust bearing surface formed on the camshaft and a cooperting thrust bearing surface formed on the tappet body for axially locating said camshaft relative to the cylinder head assembly.

13. In a camshaft arrangement as set forth in claim 9 wherein the engine has at least two cylinders with three valves for each of the cylinders and three lobes associated with each of the cylinders on the camshaft and further including drive means for driving said camshaft between said cylinders.

14. In a camshaft arrangement as set forth in claim 13 further including bolting means for bolting said bearing cap to said cylinder head assembly comprising a pair of stud receiving openings disposed on opposite sides of each of said bearing cap bearing surfaces.

15. In a camshaft arrangement as set forth in claim 14 wherein the cylinder head assembly comprises a cylinder head adapted to reciprocally support the poppet valves, a tappet body interposed between said cylinder head and said bearing cap and having bores for slidably supporting tappets interposed between the bearing lobes and the poppet valves.

16. In a camshaft arrangement as set forth in claim 15 further including a thrust bearing surface formed on the camshaft and a cooperating thrust bearing surface formed on the tappet body for axially locating said camshaft relative to the cylinder head assembly.

* * * * *